US005643486A

United States Patent [19]

Aurensan et al.

[11] Patent Number: 5,643,486

[45] Date of Patent: Jul. 1, 1997

[54] MOTION TRANSFER MECHANISM FOR DOMESTIC OVEN TRAY

[75] Inventors: Jean-Claude Aurensan, Falaise; Michel Guy De Matteis, Cambes-en-Plaine; Eric Leparfait, Saint-Aubin-sur-Mer, all of France

[73] Assignee: Moulinex S.A., Bagnolet, France

[21] Appl. No.: 535,215

[22] PCT Filed: Apr. 29, 1994

[86] PCT No.: PCT/FR94/00494

§ 371 Date: Oct. 26, 1995

§ 102(e) Date: Oct. 26, 1995

[87] PCT Pub. No.: WO94/27092

PCT Pub. Date: Nov. 24, 1994

[30] Foreign Application Priority Data

May 6, 1993 [FR] France ..... 93 05465

[51] Int. Cl.[6] ..... H05B 6/78; F24C 15/16

[52] U.S. Cl. ..... 219/752; 219/762; 219/753; 126/338; 99/421 H

[58] Field of Search ..... 219/752, 753, 219/762; 126/338, 340; 99/421 H, DIG. 14

[56] References Cited

U.S. PATENT DOCUMENTS

| | | | |
|---|---|---|---|
| 1,958,348 | 5/1934 | Raley . | |
| 2,069,706 | 2/1937 | Gerwig et al. . | |
| 4,471,195 | 9/1984 | Ishii et al. | 219/752 |
| 4,717,802 | 1/1988 | Colato | 219/755 |
| 4,810,856 | 3/1989 | Jovanovic | 99/421 H |
| 4,822,967 | 4/1989 | Kumagami et al. | 219/752 |
| 4,985,607 | 1/1991 | Oya | 219/752 |

FOREIGN PATENT DOCUMENTS 789621 11/1935 France .

*Primary Examiner*—Philip H. Leung
*Attorney, Agent, or Firm*—Young & Thompson

[57] ABSTRACT

The oven comprises a housing (1) enclosing an open cavity (4) which is closed by a door (6) pivotally mounted about a horizontal shaft (8) placed in the housing. The cavity includes a food-carrying tray (5) horizontally translatable via at least one motion transfer mechanism (10) controlled by the door. The motion transfer mechanism (10) includes several transmission stages, each consisting of a notched belt (12;23) meshing with two toothed wheels (13, 19; 26, 28) set respectively on two horizontal shafts, the shaft of one of the two wheels of the stage level being comprised of the pivoting shaft (8) of the door, and the shaft of one of the two wheels of the last stage extending into the cavity (4) and bearing another toothed wheel (35) that meshes with teeth on a lower edge (**5*a*) of the food-carrying tray (5**). The invention relates for instance to microwave ovens.

10 Claims, 3 Drawing Sheets

MOTION TRANSFER MECHANISM FOR DOMESTIC OVEN TRAY

FIELD OF THE INVENTION

The present invention relates to a domestic oven having a casing with a vertical front face and enclosing a heating cavity open at its front face and designed to be closed off by a door mounted so as to pivot about a horizontal shaft situated in the casing, the said cavity being equipped with a plate which supports food to be heated.

More particularly, it concerns a domestic oven whose food-carrying plate is able to move in horizontal translation under the action of at least one movement transmission mechanism controlled by the door, disposed in the casing and able, on the one hand, to transform the pivoting movement of the door into a translational movement of the food-carrying plate and, on the other hand, to effect a movement of the food-carrying plate such that the latter comes to occupy either an engaged position in which it is entirely contained within the cavity when the door is closed, or a disengaged position in which it projects transversely from the cavity when the door is open.

BACKGROUND OF THE INVENTION

This type of domestic oven is particularly advantageous since as it enables the food to be positioned or withdrawn while avoiding any risk of burning for the user. However, in such an oven, the transmission mechanism suitable for effecting the horizontal movement of the food-carrying plate in response to the pivoting of the door generally consists of a complex set of linkages articulated on one another, which makes the transmission mechanism a complicated one.

The invention aims notably to overcome this drawback by producing an oven such that the movement transmission mechanism between the door and the food-carrying plate is of a simple, economical and reliable design.

SUMMARY OF THE INVENTION

According to the invention, the transmission mechanism includes several successive transmission stages associated with one another and each consisting of a notched belt mounted so as to mesh on two rotating toothed wheels, of the driving and driven type respectively, which are keyed respectively on two horizontal shafts, parallel to one another, the shaft of the driving toothed wheel of the first stage consisting of the pivot shaft of the door and the shaft of the driven toothed wheel of the last stage having one end which projects transversely into the cavity and which carries a rotating toothed wheel referred to as the drive wheel meshing with teeth formed on a lower edge of the food-carrying plate and extending over the entire length of the latter.

The transmission stages are preferably two in number, the driving toothed wheel of the second stage being keyed on the same shaft as the driven toothed wheel of the first stage.

BRIEF DESCRIPTION OF THE DRAWINGS

Other characteristics and advantages of the invention will, furthermore, emerge from the description that follows, as a non-limitative example, with reference to the accompanying drawings in which.

DETAILED DESCRIPTION OF THE INVENTION

The description of the invention which follows is given with reference to a microwave oven used in particular, but not exclusively, for the thawing and reheating of a frozen food product, it being understood that the invention applies equally to any type of electric oven, whether independent or integrated into a cooking appliance such as a cooker.

Figure 1:
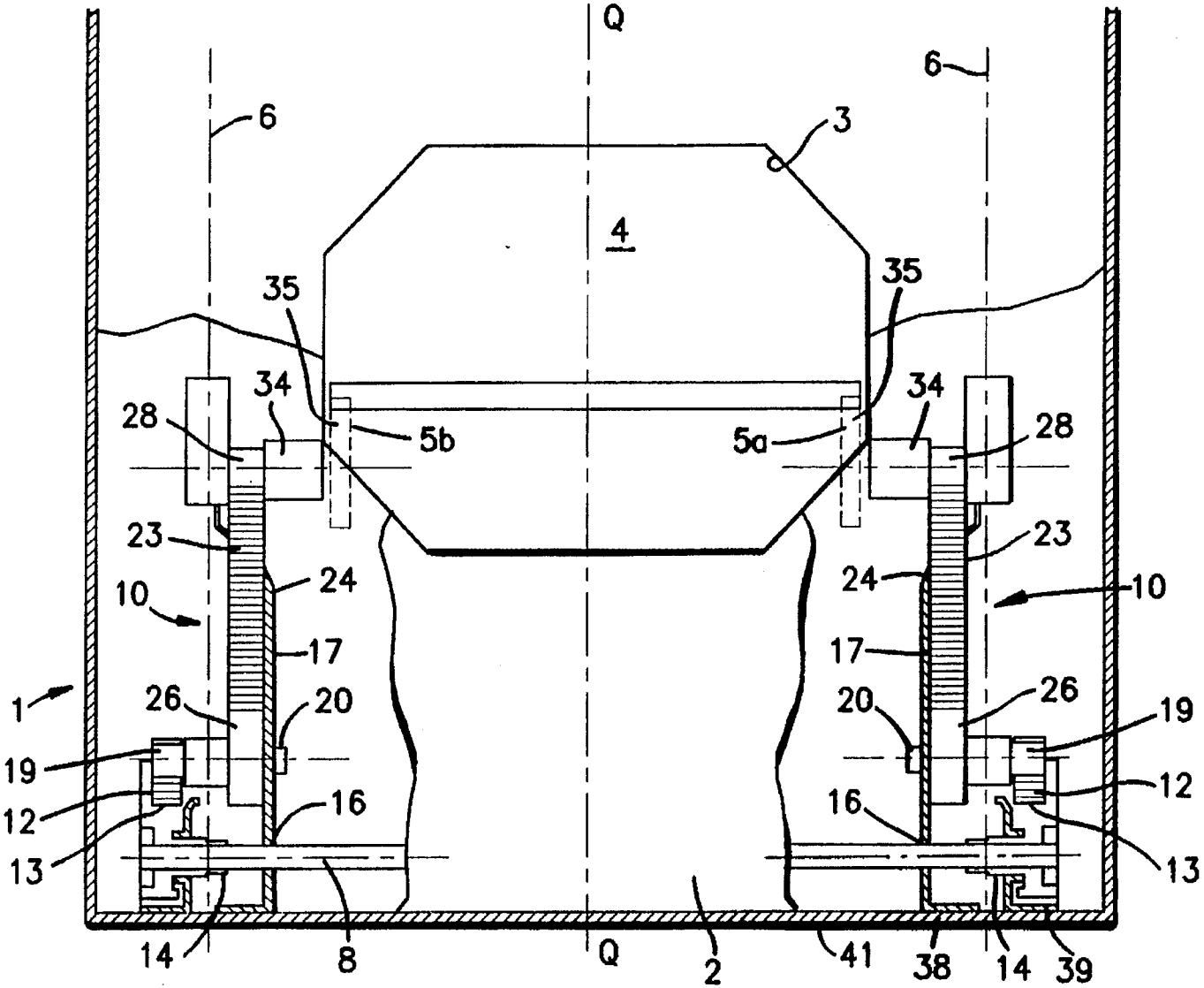
FIG. 1 is a schematic view in partial elevation of the oven according to the invention, the door being in the closed position (with the food-carrying plate in the cavity)
Figure 3:
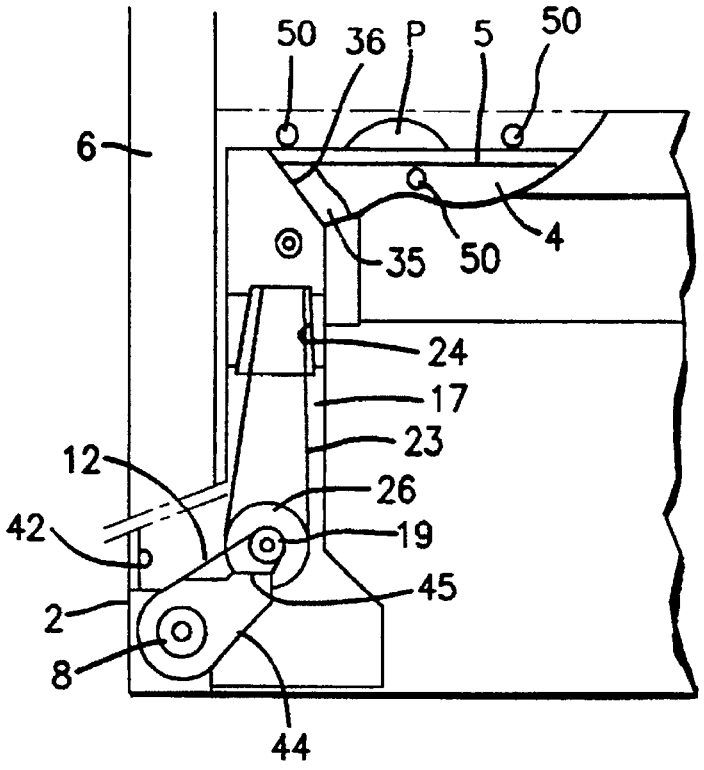
FIGS. 3 and 4 are partial schematic views of the side of the oven showing, on the one hand, the door in the closed position and the food-carrying plate in the cavity (FIG. 3) and, on the other hand, the door in the open position and the food-carrying plate projecting from the cavity (FIG. 4).
Figure 4:
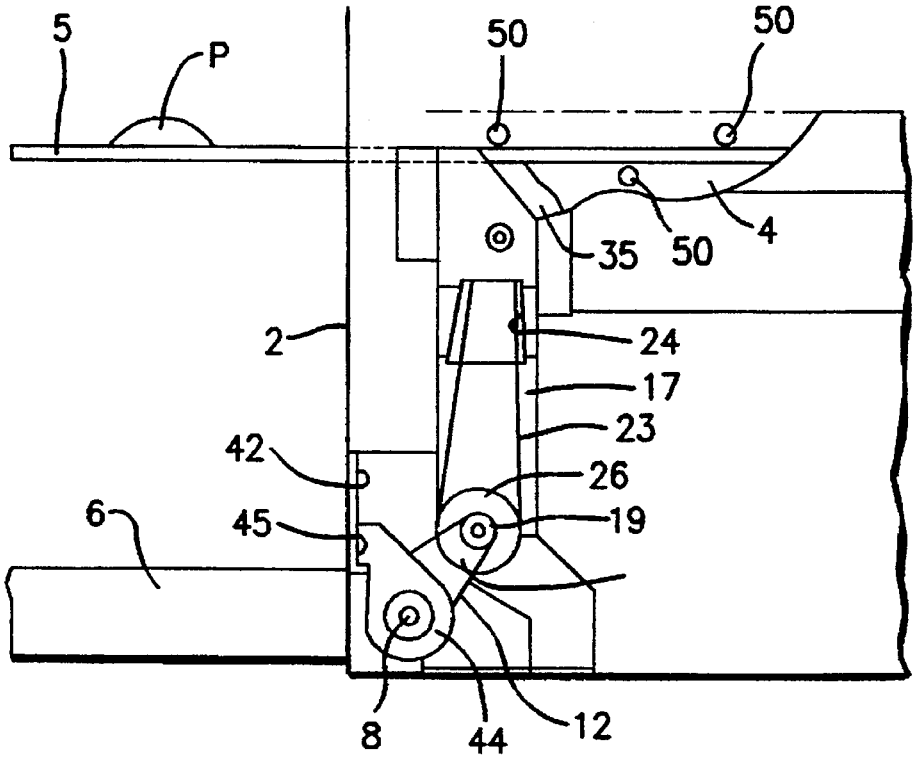

The microwave oven depicted in FIG. 1 has a casing 1, for example in the shape of an upright parallelepiped, having a vertical front face 2, one part of which is slightly recessed and has a front opening 3 leading to an inner heating cavity 4, for example octagonal in shape, in which a rectangular plate 5 which supports a frozen food product P visible in FIGS. 3 and 4 is transversely disposed, and which is able to move in horizontal translation under the action of the door, as will be seen later.

At least one microwave radiation feed (not marked) connected to a microwave emitter leads into the cavity 4; optionally, at least one infrared radiation feed (not marked) also leads into the cavity 4, this feed being connected to an infrared emitter.

The front opening 3 of the casing 1 is closed off, during the operation of the oven, by a door 6 (partially shown in broken lines in FIG. 1) which is mounted so as to pivot about a horizontal shaft 8 situated in the bottom part of the casing 1 and sized so as to fit in the recessed part of the front face 2 in order to reconstitute, with the latter, a perfectly flat surface.

The door 6 has protection means (not shown) which, when the door is closed and the oven in operation, ensure a seal against microwaves and, if applicable, against infrared radiation.

The carrying plate 5 for the food product is produced from a material that is transparent to microwaves, such as for example a ceramic coated with a glass-based enamel which is easy to look after.

In the example embodiment depicted in FIG. 1, the oven has two identical movement transmission mechanisms, each designated by the general reference number 10, which are totally integrated into the casing 1 at the side, in the immediate vicinity of the front face 2 of the latter, extending substantially vertically and symmetrically with respect to a median plane Q passing through the cavity 4, and which are each interposed between the shaft 8 of the door 6 and one of the two bottom edges *5a*, *5b* of the carrying plate 5 for the food product.

Each of these two transmission mechanisms 10 is suitable, on the one hand, for transforming the pivoting movement of the door 6 into a horizontal translational movement of the carrying plate 5 for the food product and, on the other hand, for effecting a movement of the said plate 5 such that the latter comes to occupy either an engaged position in which it is entirely contained within the cavity 4 when the door 6 is closed (see FIG. 3), or a disengaged position in which it projects transversely from the cavity 4 when the door 6 is open, for example at 90° (see FIG. 4).

Since the two transmission mechanisms 10 illustrated in FIG. 1 are identical, only a single one will be described hereinafter, for example the one shown on the right in FIG. 1, in order to simplify the description.

Figure 2:
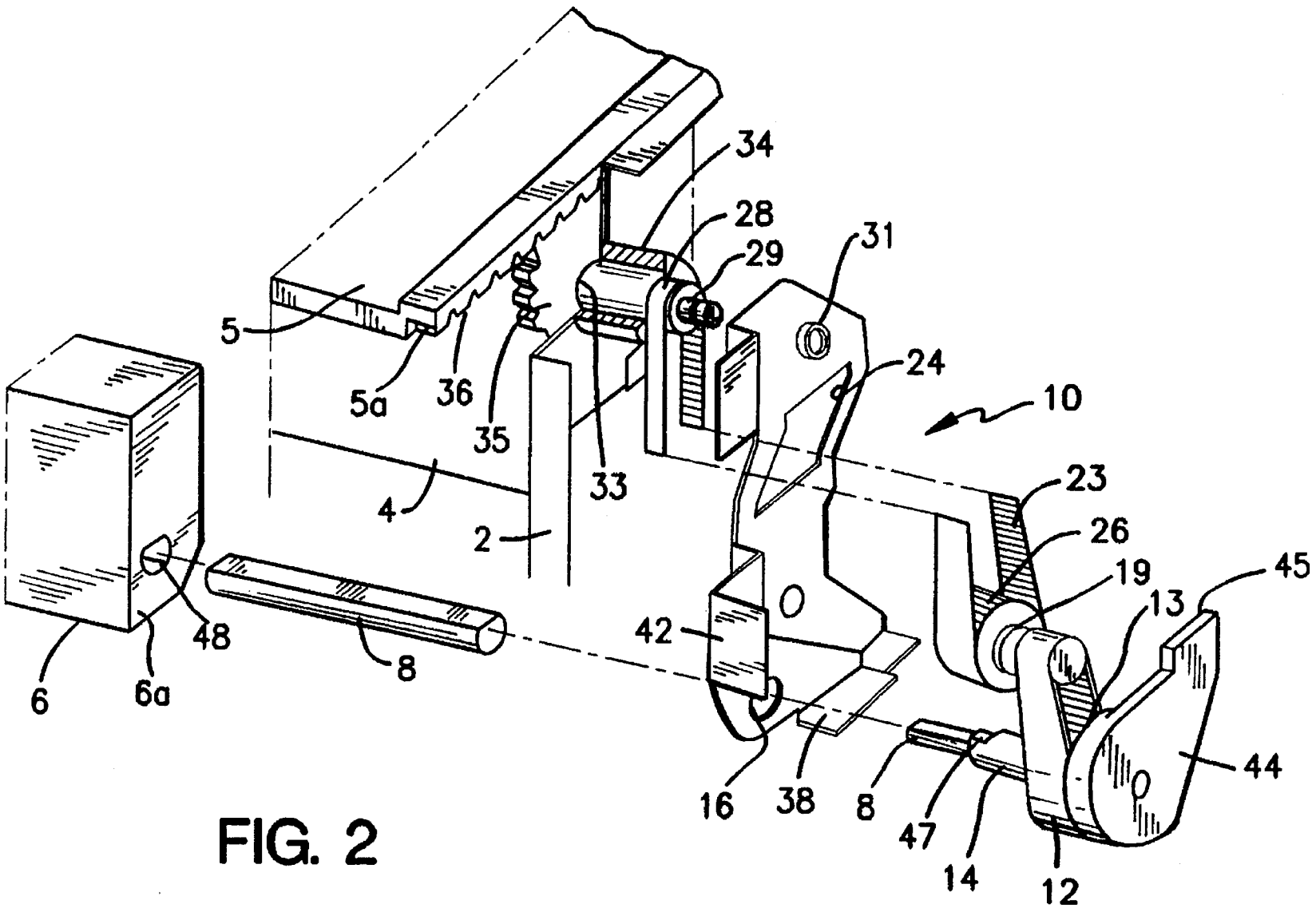
FIG. 2 is a partial view in exploded perspective of one of the two transmission mechanisms coupling the door to the food-carrying plate.

As regards FIGS. 1 and 2, the transmission mechanism 10 in accordance with the invention includes several successive transmission stages, two stages in this case, the first of which comprises a flat notched belt 12 which is mounted to mesh both on a large lower toothed wheel 13, of the driving type, keyed on a horizontal shaft 14 which is mounted on the shaft 8 of the door 6, at one end of the latter, and which is engaged in a bore 16 formed in a vertical plate forming a bearing 17 integral with the casing, and on a small upper toothed wheel 19, of the driven type, keyed on one end of a horizontal shaft 20 parallel to the shaft 14 and engaged in a bore 21 formed in the plate 17. The second transmission stage also comprises a flat notched belt 23, appreciably longer than the belt 12, which extends through an opening 24 formed in the plate 17 and which is mounted so as to mesh both on a large lower toothed wheel 26, of the driving type, keyed on the shaft 20 and positioned on the same side as the toothed wheel 19 with respect to the plate 17, and on a small upper toothed wheel 28, of the driven type, positioned on the opposite side to the toothed wheel 26 with respect to the said plate 17 and keyed on a horizontal shaft 29, in the vicinity of one end of the latter, which is engaged in a bore 31 formed in the plate 17. This shaft 29 projects transversely at its other end 33 into the cavity 4, at a predetermined level of the latter, and is sheathed in a cylindrical sealing sleeve 34 produced from a material that insulates against microwaves, such as a ceramic, for example. The projecting end 33 of the shaft 29 carries a large toothed drive wheel 35, of the driving type, cooperating by meshing with teeth 36 forming a rack which is formed over the entire length of the lower edge 5*a* of the carrying plate 5 for the food product.

This synchronous belt transmission mechanism provides not only a good degree of sliding movement for the plate 5, but also flexible and silent functioning.

The plate 17, FIG. 2, has at its base two flat horizontal flanges 38, 39 which are fixed, for example by welding, to the base 41 of the casing 1 (FIG. 1), and, on its front edge, a flat vertical flange 42 which is fixedly applied to it, for example by welding, on the inner part of the front face 2 of the casing 1 (FIGS. 3 and 4).

As shown in FIG. 2, the toothed wheel 13 has a lateral member 44 having a thin flat section forming a heel 45, keyed at an angle on the shaft 14 and able to come to bear against the vertical flange 42 of the plate 17 at the end of the opening of the door 6, so as to keep the door 6 in the open position according to the opening angle chosen, in this case 90°. In this respect, the vertical flange 42 of the plate 17 advantageously forms an inner armouring of the front face 2 of the casing vis-à-vis the stop heel 45 when the door 6 pivots from its closed position to its open position.

In FIG. 2, the control shaft 14 of the toothed wheel 13 has a flat 47 on which the lateral face 6*a* of the door 6 is mounted by means of a corresponding bore 48 formed in the latter. This flat 47 ensures better pivoting in the door 6 and gives the latter greater rigidity, which is necessary when the oven is used almost continuously, as in the field of fast food, for example.

It should be noted that the travel of the carrying plate 5 for the food product is determined according to the angular movement of the door 6 and the reduction ratio between the driving (13, 26, 35) and driven (19, 28) toothed wheels of the transmission mechanism 10. To give an example, in no way limitative, for an angular movement of the door of 90° and a reduction ratio of around 4, the travel of the carrying plate for the food product is around 150 millimeters.

Preferably, the cavity 4 has guide means for the moving plate 5 carrying the food product. In the example embodiment illustrated in FIGS. 3 and 4, these guide means consist of fixed pins 50 mounted transversely in the cavity 4 and disposed in a zig-zag along the upper and lower edges of the plate 5.

The cavity 4 also has coupling/uncoupling means (not shown) which, when the oven is not operating, enable the plate 5 to be made removable so as to facilitate its cleaning as well as that of the cavity.

FIG. 3 shows the carrying plate 5 for the food product P in the engaged position in which it is entirely contained within the cavity 4 when the door 6 is closed.

Following thawing and reheating of the food product P, the user opens the door 6, whose pivot shaft 8 rotates anti-clockwise the toothed wheel 13 (FIG. 2), whose rotation movement is transmitted to the toothed wheel 19 by means of the belt 12, as well as to the toothed wheel 26 keyed on the same shaft 20 as the wheel 19. The toothed wheel 26 in turn transmits its rotation movement to the toothed wheel 28 by means of the belt 23, as well as to the toothed drive wheel 35 keyed on the same shaft 29 as the wheel 28. Through its rack meshing with the carrying plate 5 for the food product P, the toothed wheel 35 drives the plate 5 in horizontal translation, which comes to project from the cavity 4 to occupy, at the end of the 90° opening of the door 6, its disengaged position shown in FIG. 4. At the end of the opening of the door 6, the heel 45 of the member 44 carried by the toothed wheel 13 comes to bear against the inner flange 42 applied against the front face 2 of the casing.

When the user closes the door 6, the carrying plate 5 for the food product P moves from its disengaged position (FIG. 4) to its engaged position (FIG. 3) under the action of the toothed wheels in a rotation movement which is the reverse of that described previously.

We claim:

1. Domestic oven comprising a casing (1) with a vertical front face (2) and enclosing a heating cavity (4) open at its front face and designed to be closed off by a door (6) mounted so as to pivot about a horizontal shaft (8) situated in the casing, said cavity (4) being equipped with a plate (5) which supports food to be heated and which is able to move in horizontal translation under the action of at least one movement transmission mechanism (10) controlled by the door (6), disposed in the casing (1) and able to transform the pivoting movement of the door (6) into a translational movement of the food-carrying plate (5) such that the plate comes to occupy either an engaged position in which it is entirely contained within the cavity (4) when the door (6) is closed, or a disengaged position in which it projects transversely from the cavity (4) when the door (6) is open, wherein the transmission mechanism (10) includes a plurality of successive transmission stages associated with one another and each consisting of a notched belt (12; 23) mounted so as to mesh on two rotating toothed wheels (13, 19; 26, 28), of the driving and driven type respectively, which are keyed respectively on two horizontal shafts (8, 20; 20, 29), parallel to one another, the shaft of the driving toothed wheel (13) of the first stage consisting of the pivot shaft (8) of the door (6) and the shaft (29) of the driven toothed wheel (28) of the last stage having one end (33) which projects transversely into the cavity (4) and which carries a rotating toothed wheel referred to as the drive wheel (35) meshing with teeth (36) formed on a lower edge of the food-carrying plate (5) and extending over the entire length of the plate.

2. Domestic oven according to claim 1, wherein the transmission stages are two in number, the driving toothed wheel (26) of the second stage being keyed on the same shaft (20) as the driven toothed wheel (19) of the first stage.

3. Domestic oven according to claim 2, wherein the notched belt (23) of the second transmission stage is appreciably longer than that (12) of the first stage.

4. Domestic oven according claim 1, wherein the respective shafts (8, 20, 29) of the transmission stages are mounted in bores (16, 21, 31) formed in a single plate forming a bearing (17) integral with the casing.

5. Domestic oven according to claim 4, wherein the plate forming a bearing (17) has a vertical flange (42) applied against the inner part of the front face (2) of the casing, and in that the driving toothed wheel (13) of the first transmission stage, keyed on the tilting shaft (8) of the door, has a member (44) with a heel (45), able to come to bear against the said flange (42) on the plate at the end of the opening of the door.

6. Domestic oven according claim 1, wherein the toothed wheels (13, 19, 26, 28, 35) of all the transmission stages have between them a transmission ratio that is determined so as to permit a relatively long travel in the food-carrying plate (5) when the door (6) pivots either from its closed position to its open position, or from its open position to its closed position.

7. Domestic oven according to claim 1, wherein guide means (5) are disposed in the cavity (4) in order to guide the food-carrying plate (5) during its movement.

8. Domestic oven according to claim 1, wherein the cavity (4) is subjected to microwave radiation, and the part of the shaft (29) of the driven toothed wheel (28) of the final transmission stage, situated between this driven toothed wheel (28) and the toothed driving wheel (35) positioned in the cavity, is sheathed in a sleeve (34) that is impervious to microwaves.

9. Domestic oven according to claim 8, wherein the food-carrying plate (5) is produced from a material that is transparent to microwaves.

10. Domestic oven according to claim 9, wherein the material transparent to microwaves is a ceramic coated with a glass-based enamel.

* * * * *